US008250811B2

(12) United States Patent
Zijlstra

(10) Patent No.: US 8,250,811 B2
(45) Date of Patent: Aug. 28, 2012

(54) CANE BOLT WITH SPRING AND SLOTTED STOP

(75) Inventor: Sjirk W. Zijlstra, Solana Beach, CA (US)

(73) Assignee: Sjirk W. Zijlstra, Solana Beach, CA (US)

( * ) Notice: Subject to any disclaimer, the term of this patent is extended or adjusted under 35 U.S.C. 154(b) by 379 days.

(21) Appl. No.: 12/694,684

(22) Filed: Jan. 27, 2010

(65) Prior Publication Data

US 2011/0179720 A1 Jul. 28, 2011

(51) Int. Cl.
*E05B 65/06* (2006.01)

(52) U.S. Cl. ..... 49/394; 292/57; 292/58; 292/60; 292/62; 292/64; 292/63; 292/69; 292/DIG. 15; 292/DIG. 29

(58) Field of Classification Search ..... 49/394; 292/137, 163, 173, 143, 57, 58, 60, 62, 63, 292/64, 69, DIG. 15, DIG. 29; 256/73
See application file for complete search history.

(56) References Cited

U.S. PATENT DOCUMENTS

| | | | | | |
|---|---|---|---|---|---|
| 766,012 | A | * | 7/1904 | Albright | 292/60 |
| 1,086,749 | A | * | 2/1914 | Brenneman | 292/175 |
| 1,214,230 | A | * | 1/1917 | Sheppard | 292/75 |
| 1,394,513 | A | * | 10/1921 | Albonesi | 292/60 |
| 1,440,025 | A | * | 12/1922 | Nicholson | 292/67 |
| 1,548,907 | A | * | 8/1925 | Schweim | 292/62 |
| 1,602,264 | A | * | 10/1926 | Hutchison | 292/60 |
| 3,174,314 | A | * | 3/1965 | Johnson | 70/77 |
| 4,050,723 | A | * | 9/1977 | Papadatos | 292/164 |
| 5,415,256 | A | * | 5/1995 | Weigand et al. | 192/13 R |
| 2003/0038283 | A1 | * | 2/2003 | Stevenson | 256/73 |

* cited by examiner

*Primary Examiner* — Katherine W Mitchell
*Assistant Examiner* — Marcus Menezes
(74) *Attorney, Agent, or Firm* — John L. Rogitz

(57) ABSTRACT

A cane bolt is spring biased up to allow a movable barrier with which the cane bolt is engaged to move. The cane bolt can be pushed down into a strike hole to prevent movement of the barrier. To hold the cane bolt down, a pin on the cane bolt abuts a slotted stop on the barrier. To raise the cane bolt, the cane bolt is simply rotated so that the pin aligns with and thus passes through the slot, allowing the spring to urge the cane bolt up.

15 Claims, 3 Drawing Sheets

CANE BOLT WITH SPRING AND SLOTTED STOP

I. FIELD OF THE INVENTION

The present invention relates generally to assemblies and methods for opening and closing fence gates.

II. BACKGROUND OF THE INVENTION

Cane bolts are used to hold barriers such as swinging gates closed. The cane bolt slides up and down on the gate and when the gate is closed, the bottom of the cane bolt is positioned over a hole in the ground into which the cane bolt is lowered to hold the gate closed. To open the gate, the cane bolt is lifted out of the hole and the gate may then be swung open.

As understood herein, it is typically the case that the cane bolt is released once it is removed from the hole, which causes the cane bolt to drop back down against the ground. As further understood here, as the gate is moved the cane bolt drags against the ground, resulting in scores in the ground and damage to the cane bolt.

SUMMARY OF THE INVENTION

Accordingly, an assembly includes an elongated rigid cane bolt engageable with a movable barrier to selectively hold the movable barrier stationary with respect to a fixed barrier. The cane bolt defines a long axis and a pin extending away from the long axis. A spring is coupled to the cane bolt to bias the cane bolt to a raised position in which a bottom end of the cane bolt is above the ground. A stop is engageable with the movable barrier and defines a central opening through which the cane bolt moves but through which the pin cannot move. The stop also defines a slot through which the pin can move when aligned with the slot. With this structure, the cane bolt is manually movable against the spring to a lowered position and then rotatable to assume an angular orientation in which the pin is below the stop and is not aligned with the slot to thereby cause the pin to abut a bottom surface of the stop under the influence of the spring while preventing the spring from raising the cane bolt from the lowered position. The cane bolt is then rotatable to assume an angular orientation in which the pin is aligned with the slot to thereby permit the pin to pass through the slot to in turn permit moving the cane bolt between the raised and lowered positions.

In some implementations, the cane bolt defines an upper end opposite the bottom end and a handle on the upper end extending away from the axis of the cane bolt. In examples, when the movable barrier is in a closed position with respect to the fixed barrier the bottom end of the cane bolt is disposed in a strike hole in the ground below the movable barrier to thereby hold the movable barrier stationary relative to the fixed barrier.

In example embodiments, the stop can be established by a metal washer. An example stop can define first and second slots arranged opposite each other with respect to the central opening. A spring support can be engaged with the movable barrier below the stop and a spring trap can be coupled to the cane bolt above the spring support and below the stop. The spring is disposed in compression between the spring support and the spring trap when the assembly is engaged with the movable barrier. The spring trap cannot pass through the central opening of the stop.

In another aspect, a barrier assembly includes a fixed barrier, a movable barrier movable relative to the fixed barrier between an open configuration and a closed configuration, and an elongated rigid holder vertically disposed on the movable barrier and movable between a raised position and a lowered position. A resilient member is coupled to the holder to urge the holder toward the raised position. Also, an interference element is positioned to prevent the holder from being urged away from the lowered position when the holder assumes a first angular orientation with respect to the movable barrier and to allow the holder to be urged away from the lowered position when the holder assumes a second angular orientation with respect to the movable barrier.

In another aspect, a cane bolt assembly includes a cane bolt, a stop through which the cane bolt moves, and a pin coupled to the cane bolt to move therewith. The pin passes through the stop when the cane bolt assumes a first angular orientation and cannot pass through the stop when the cane bolt assumes a second angular orientation.

DETAILED DESCRIPTION OF THE PREFERRED EMBODIMENT

Figure 1:
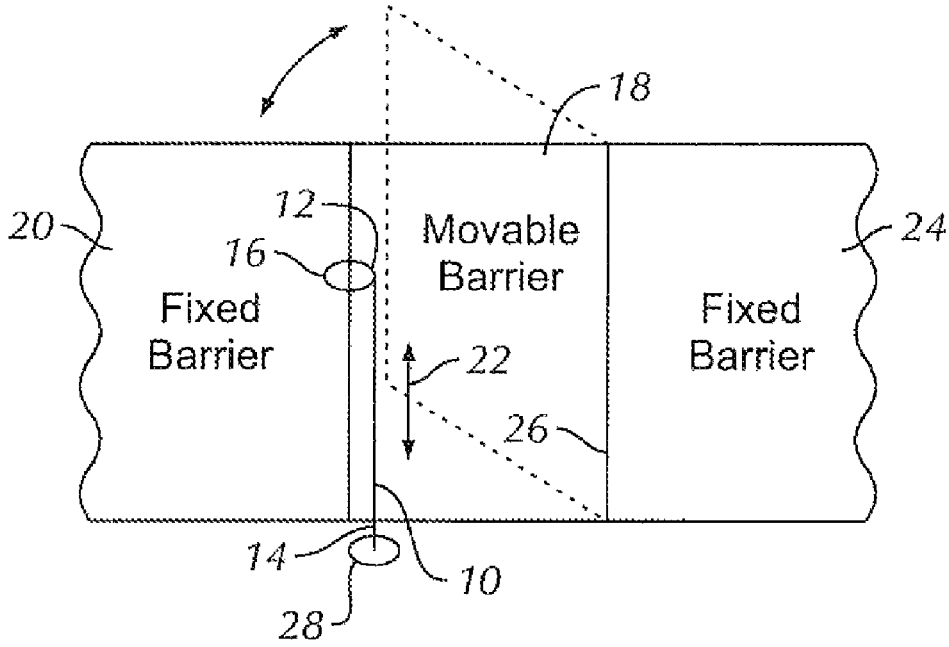
FIG. 1 is a schematic diagram showing the present cane bolt assembly engaged with a swinging gate.

Beginning initially with FIG. 1, a schematic diagram showing a cane bolt assembly engaged with a swing gate is shown. Among other things described in FIGS. 3-5 below, the cane bolt assembly 10 includes opposing ends 12 and 14 where, in the non-limiting embodiment shown in FIG. 1, end 12 is an upper end and end 14 is a bottom end. Also, the assembly 10 has a handle 16 on the upper end 12. The assembly 10 is engageable with a movable barrier 18 to selectively hold the movable barrier 18 stationary with respect to a fixed barrier 20. The movable barrier 18 may be, in non-limiting embodiments, any type of gate typically placed between ends of a fence allowing access to opposite sides of the fence.

It is to be understood that, in non-limiting embodiments, the cane bolt assembly 10 is vertically disposed along the movable barrier 18 to define a long axis 22 and has a pin (not shown) extending away from the long axis 22. Further, it is to be understood both that the handle 16 on the assembly 10 extends away from the axis 22 and that the assembly 10 can reciprocate vertically along the axis 22. The cane bolt assembly 10 will be described in greater detail in reference to FIGS. 3-5 below.

Still referencing FIG. 1, another fixed barrier 24 may be coupled to the fixed pivot 26 of the movable barrier 18 in non-limiting embodiments. Thus, it may be appreciated that, in non-limiting embodiments, the movable barrier 18 may have open and closed configurations establishing a swinging gate in a fence or other structure. When the movable barrier 18 is in a closed position with respect to the fixed barrier 20, the assembly 10 may be placed in the extended position such that the bottom end 14 of the cane bolt assembly 10 may be disposed in a strike hole 28 below the movable barrier 18 to hold the assembly 10 and, thus, the movable barrier stationary. That is, when the end 14 is disposed in the strike hole 28, the movable barrier 18 is stationary relative to the fixed barrier 20.

Figure 2:
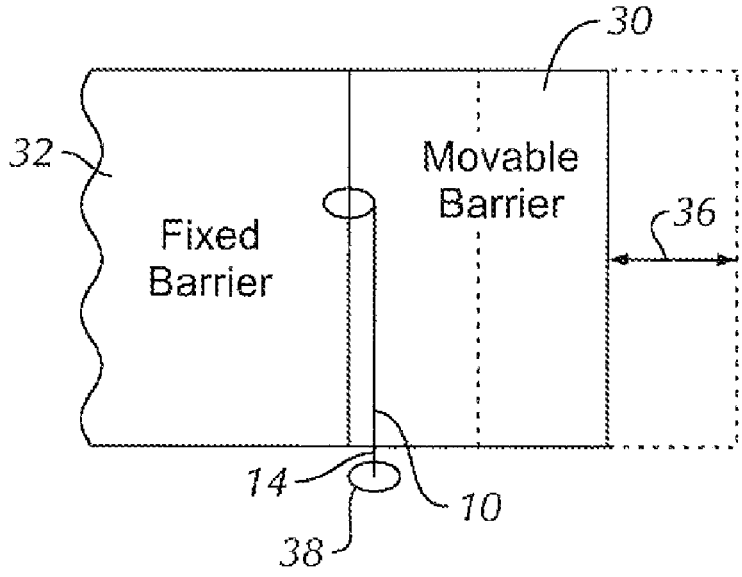
FIG. 2 is a schematic diagram showing the present cane bolt assembly engaged with a horizontally sliding gate.

Now referencing FIG. 2, a similar cane bolt assembly to that described in FIG. 1 is shown. However, FIG. 2 provides another non-limiting example embodiment of the cane bolt assembly where the assembly 10 is instead engaged with a horizontally sliding gate that is part of a fence or other structure.

In FIG. 2, the cane bolt assembly 10 is engageable with a movable barrier 30 to selectively hold the movable barrier 30 stationary with respect to a fixed barrier 32. The movable barrier 30 is generally movable along a horizontal axis 36 which is perpendicular to the long axis of the cane bolt. Thus, it may now be appreciated that the movable barrier 30 in FIG. 2 may have open and closed configurations that establish a sliding gate rather than a swinging one, where the movable barrier 30 generally slides along the axis 36.

It is to be further understood that a strike hole 38 is below the movable barrier 30. Thus, when the movable barrier 30 is in the closed position with respect to the fixed barrier 32, the assembly 10 may be placed in the extended position such that the bottom end 14 of the cane bolt assembly 10 may be disposed in a strike hole 38 below the movable barrier 30. Thus, when the end 14 is disposed in the strike hole 38, the movable barrier 30 is stationary relative to the fixed barrier 32.

Figure 3:
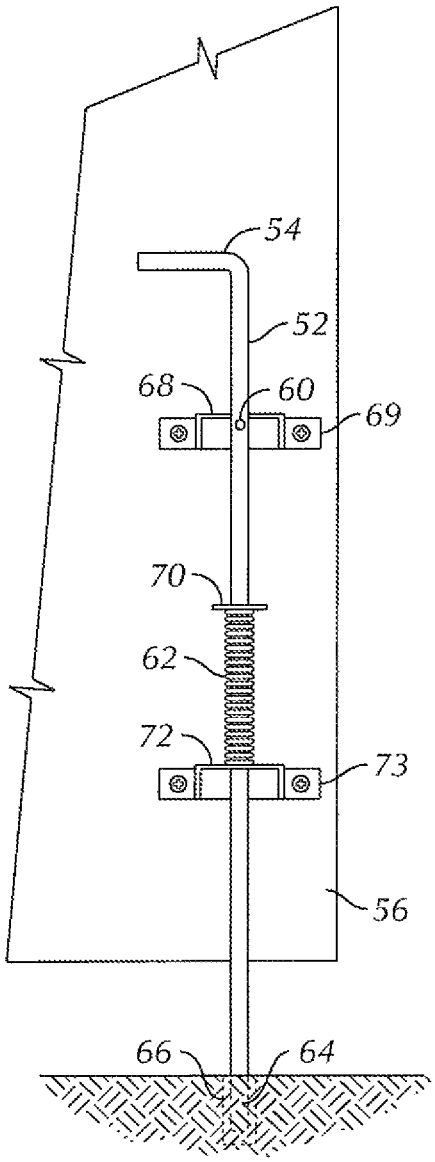
FIG. 3 is a side view of an example cane bolt assembly in accordance with present principles in the lowered position with the cane bolt assuming a first angular orientation to prevent the spring from pushing the cane bolt up.
Figure 4:
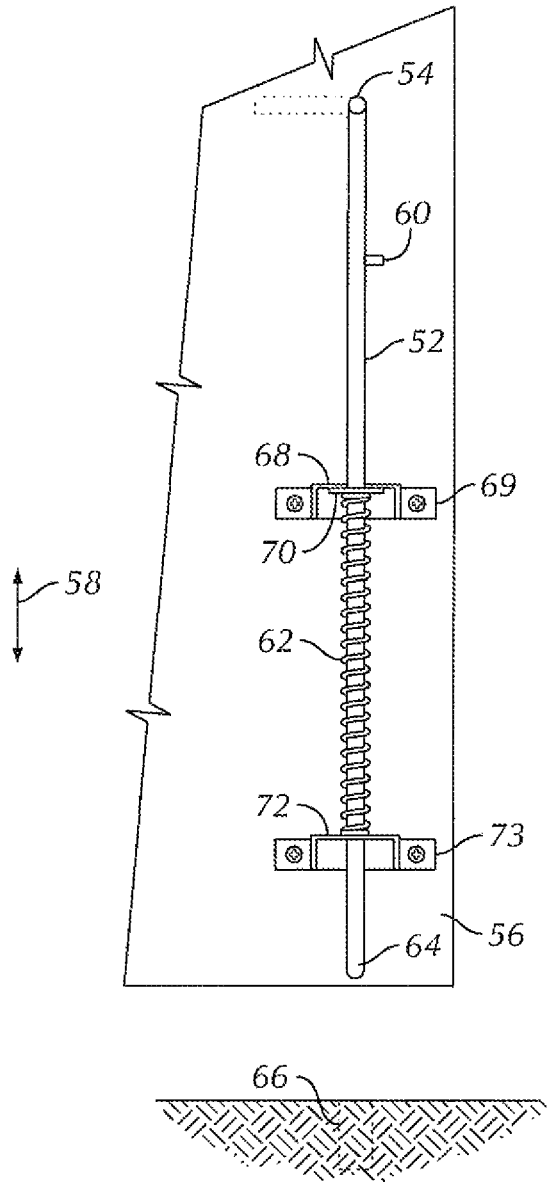
FIG. 4 is a side view of the example cane bolt assembly in FIG. 4 but in the raised position with the cane bolt assuming a second angular orientation which aligns the pin with the slot enable the cane bolt to be pushed up by the spring.

Moving to FIGS. 3 and 4, both figures show in greater detail the cane bolt assembly 10 referenced in FIGS. 1 and 2. Particularly referencing FIG. 3, a side view of an example cane bolt assembly in accordance with present principles is shown. In FIG. 3, the assembly is in the lowered position where a cane bolt assumes a first angular orientation to prevent a spring from pushing the cane bolt up. With respect to FIG. 4, a side view of the example cane bolt assembly in FIG. 3 but in the raised position is shown. In FIG. 4, the cane bolt assumes a second angular orientation which aligns a pin with a slot to enable the cane bolt to be pushed up by the spring. In some non-limiting embodiments, the first angular orientation and the second angular orientation may be orthogonal to each other.

In reference to FIGS. 3 and 4, an elongated rigid cane bolt 52 having a handle 54 is shown in both. The cane bolt 52 is understood to be engageable with a movable barrier 56 to selectively hold the movable barrier 56 stationary with respect to a fixed barrier (not shown in FIG. 3 or 4). Further, the cane bolt 52 defines a long axis 58. A rigid pin 60 extends away from the long axis 58, preferably horizontally as shown.

A coil spring 62 coupled to the cane bolt 52 is shown in both FIGS. 3 and 4. The spring 62 biases the cane bolt 52 to the raised position shown in FIG. 4. Thus, the spring is held in compression as will be described further below. It is to be understood that the coil spring 62 shown in the non-limiting embodiment of FIGS. 3 and 4 is but one example of a resilient member which may be used in accordance with present principles. Other examples of resilient members which may be used include a leaf spring, a compressed resilient rubber or plastic foam tube.

Continuing in reference to FIGS. 3 and 4, when the cane bolt 52 is in the lowered position, the bottom end 64 of the cane bolt 52 may be disposed in a strike hole 66, as particularly shown in FIG. 3.

Still referencing FIGS. 3 and 4, a stop 68 is shown. It is to be understood that the stop 68 can be established by a hollow disk-shaped metal washer in non-limiting embodiments. The stop 68 is engageable with the movable barrier 56 by, e.g., welding or by a bracket 69, and the stop 68 defines a central circular opening, which will be discussed in FIG. 5, through which the cane bolt 52 may move but through which the pin 60 cannot move. Further, the stop 68 also defines at least one slot (not shown in FIG. 3 or 4) through which the pin 60 can move only when aligned with the slot.

Still in reference to both FIGS. 3 and 4, a spring trap 70 and a spring support 72 are also shown. The spring support 72 is fixedly engageable with the movable barrier 56 by, e.g., welding or by a bracket 73 below the stop 68. In contrast, the spring trap 70 is fixedly coupled to the cane bolt 52 as by welding, bracketing, etc. above the spring support 72 but below the stop 68. Thus, the spring 62 is disposed in compression between the spring trap 70 and the spring support 72 when the assembly 10 is engaged with the movable barrier 56. Further, it is to be understood that the spring trap 70 cannot pass through the central opening (not shown in FIG. 3 or 4) of the stop 68 along with the cane bolt 52.

It may now be appreciated that the cane bolt assembly 10 has both a lowered position as shown in FIG. 3 and a raised position as shown in FIG. 4. As shown in the non-limiting embodiment in FIG. 3, the cane bolt 52 is manually movable against the bias of the spring 62 toward the lowered position, the cane bolt 52 being rotatable to assume an angular orientation where the pin 60 is below the stop 68 and not aligned with any slot in the stop 68. Thus, the lowered position shown in FIG. 3 may cause the pin 60 to abut the bottom surface of the stop 68 under the influence of spring 62 bias while preventing the spring 62 from raising the cane bolt 52 from the lowered position. The movable barrier 56 is consequently stationary with respect to a fixed barrier (not shown) while in the lowered position.

As shown in the non-limiting embodiment in FIG. 4, the cane bolt 52 is rotatable to assume an angular orientation in which the pin 60 may be aligned with a slot in the stop 68 to thereby permit the pin 60 to pass through the slot. When the pin 60 is aligned with the slot so that it may pass through the slot, the spring 62 urges the cane bolt 52 upwardly, moving the cane bolt 52 from the lowered position shown in FIG. 3 to the raised position shown in FIG. 4. While in the raised position, the assembly 10 thereafter maintains a clearance between the bottom end 64 and both the strike hole 66 and any ground surrounding the strike hole 66.

Figure 5:
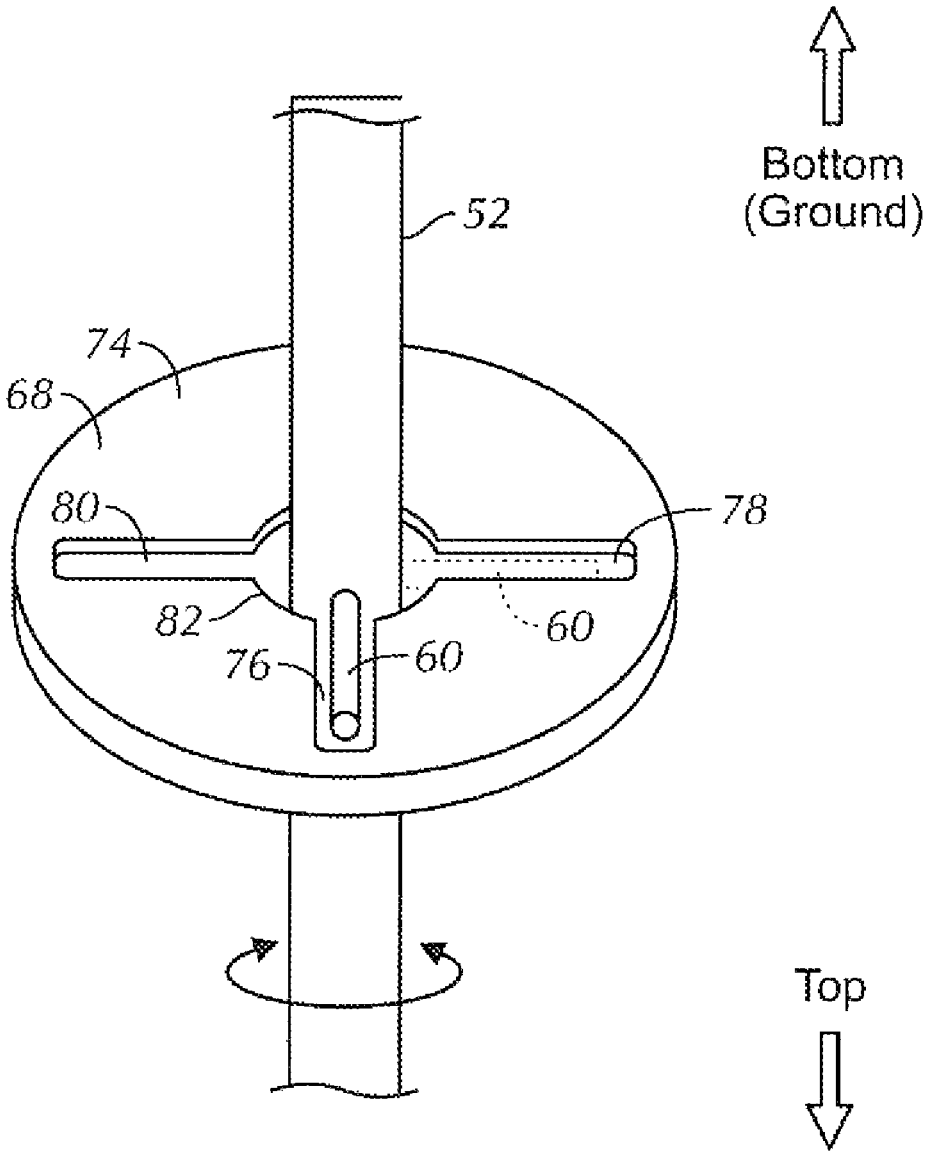
FIG. 5 is a close-up perspective view of the slotted stop from the bottom, showing the pin in solid in the first angular orientation of the cane bolt and in phantom to illustrate the second angular orientation of the cane bolt, with portions cut away for clarity.

To better understand the details of an example stop 68, FIG. 5 illustrates a close-up perspective view of the slotted stop 68 from a bottom perspective. FIG. 5 shows the pin 60 in solid in the first angular orientation of the cane bolt 52 and also in phantom to illustrate a second angular orientation of the cane bolt 52, with portions of the cane bolt cut away for clarity. The position of the solid pin 60 is understood to be the position of the pin 60 in the lowered position described above in reference to FIG. 3. When the cane bolt 52 is in the lowered position, it may now be further appreciated that the pin 60 abuts the bottom surface 74 of the stop 68 under the influence of the spring 62 bias while preventing the spring 62 from raising the cane bolt 52 from the lowered position. In one implementation, a groove 76 may be formed along a radial of the stop 68 as shown such that the pin 68 rests in the groove 76 to better hold the cane bolt in position. The groove 76 does not extend completely through the stop 68, however.

In contrast, a slot 78 is formed along a radial of the stop 68 completely through the stop 68 and, in example embodiments, orthogonal to the groove 76. The pin 60 shown in phantom is understood to be the position of the pin 60 as it passes through the slot 78 in the stop 68 as the cane bolt transitions to the raised position described above in reference to FIG. 4.

Additionally, a second slot 80 may be formed in the stop 68 opposite the first slot 78 with respect to the central circular opening 82 of the stop 68. Thus, the cane bolt can be moved to the raised position if the pin 60 is aligned with either one of the slots 78, 80.

While the particular CANE BOLT WITH SPRING AND SLOTTED STOP is herein shown and described in detail, it is to be understood that the subject matter which is encompassed by the present invention is limited only by the claims.

What is claimed is:

1. An assembly comprising:

an elongated rigid cane bolt engageable with a movable barrier to selectively hold the movable barrier stationary with respect to a fixed barrier, the cane bolt defining a long axis and a pin extending away from the long axis, the cane bolt defining a top end and a bottom end, the pin being disposed on the cane bolt distanced from the bottom end intermediate the top end and bottom end;

a spring coupled to the cane bolt to bias the cane bolt to a raised position in which a bottom end of the cane bolt is above the ground;

a stop engageable with the movable barrier and defining a central opening through which the cane bolt moves but through which the pin cannot move, the stop also defining at least one slot through which the pin can move when aligned with the slot, wherein the cane bolt is manually movable against the spring to a lowered position, in which the bottom end of the cane bolt is received in a strike hole in the ground below the movable barrier, the cane bolt being rotatable to assume an angular orientation about the long axis in which the pin is below the stop and is not aligned with the slot to thereby cause the pin to abut a bottom surface of the stop under the influence of the spring while preventing the spring from raising the cane bolt from the lowered position, the cane bolt being rotatable to assume an angular orientation about the long axis in which the pin is aligned with the slot to thereby permit the pin to pass through the slot to in turn permit moving the cane bolt between the raised and lowered positions;

a spring support engageable with the movable barrier below the stop; and a spring trap coupled to the cane bolt above the spring support and below the stop, the spring being disposed in compression between the spring support and the spring trap when the assembly is engaged with the movable barrier;

the stop being engageable with the movable barrier at an upper location above the spring trap relative to the bottom end of the cane bolt when the cane bolt is in the lowered position in which the spring is compressed between the spring trap and the spring support, the spring trap contacting the stop when the cane bolt is in the raised position in which the spring is expanded relative to the lowered position such that the spring expands and contracts between the stop and the spring trap, the stop being engaged at the upper location by welding or by a bracket, the pin being longitudinally distanced on the cane bolt from the spring trap.

2. The assembly of claim 1, wherein the cane bolt defines an upper end opposite the bottom end and a handle on the upper end extending away from the axis of the cane bolt.

3. The assembly of claim 1, wherein when the movable bather is in a closed position with respect to the fixed barrier the bottom end of the cane bolt is disposed in the strike hole in the ground below the movable barrier when the cane bolt is in the lowered position to thereby hold the movable barrier stationary relative to the fixed barrier.

4. The assembly of claim 1, wherein the stop is established by a metal washer.

5. The assembly of claim 1, wherein the stop defines first and second slots arranged opposite each other with respect to the central opening.

6. The assembly of claim 1, wherein the cane bolt is engaged with the movable barrier.

7. The assembly of claim 1, wherein the spring trap cannot pass through the central opening of the stop.

8. A barrier assembly, comprising:

a fixed barrier;

a movable barrier movable relative to the fixed barrier between an open configuration and a closed configuration;

an elongated rigid holder vertically disposed on the movable barrier and movable between a raised position and a lowered position;

a resilient member coupled to the holder to urge the holder toward the raised position; and an interference element positioned to prevent the holder from being urged away from the lowered position when the holder assumes a first angular orientation with respect to the movable barrier and to allow the holder to be urged away from the lowered position when the holder assumes a second angular orientation with respect to the movable barrier, wherein the holder includes a cane bolt having a pin, the resilient member includes a spring, and the interference element includes a stop defining a central opening through which the cane bolt moves but through which the pin cannot move, the stop also defining at least one slot through which the pin can move when aligned with the slot, further comprising a spring support engaged with the movable barrier below the stop and a spring trap coupled to the cane bolt above the spring support and below the stop, spring being disposed in compression between the spring support and the spring trap when the assembly is engaged with the movable barrier, the stop and spring trap contacting each other with the pin above the stop and distanced therefrom when the cane bolt is in the raised position, the stop and spring trap being distanced from each other with the stop above the spring trap relative to a bottom end of the cane bolt and the pin contacting a bottom surface of the stop when the pin is not aligned with the slot and the cane bolt is in the lowered position.

9. The assembly of claim 8, wherein the cane bolt is manually movable against the spring to the lowered position, the cane bolt being rotatable to assume an angular orientation in which the pin is below the stop and is not aligned with the slot to thereby cause the pin to abut a bottom surface of the stop under the influence of the spring while preventing the spring from raising the cane bolt from the lowered position, the cane bolt being rotatable to assume an angular orientation in which the pin is aligned with the slot to thereby permit the pin to pass through the slot to in turn permit moving the cane bolt between the raised and lowered positions.

10. The assembly of claim 9, wherein the cane bolt defines an upper end opposite a bottom end and a handle on the upper end extending away from a long axis of the cane bolt.

11. The assembly of claim 10, wherein when the movable barrier is in a closed position with respect to the fixed barrier the bottom end of the cane bolt is disposed in a strike hole in the ground below the movable barrier when the cane bolt is in the lowered position to thereby hold the movable barrier stationary relative to the fixed barrier.

12. The assembly of claim 9, wherein the stop is established by a metal washer.

13. The assembly of claim 9, wherein the stop defines first and second slots arranged opposite each other with respect to the central opening.

14. The assembly of claim 8, wherein the spring trap cannot pass through the central opening of the stop.

15. A barrier assembly, comprising:

a fixed barrier;

a movable barrier movable relative to the fixed barrier between an open configuration and a closed configuration;

an elongated cane bolt vertically disposed on the movable barrier and movable between a raised position and a lowered position, a pin on the cane bolt extending radially away from a long axis of the cane bolt;

a spring coupled to the cane bolt to urge the cane bolt toward the raised position;

a stop positioned to prevent the cane bolt from being urged away from the lowered position when the cane bolt assumes a first angular orientation with respect to the movable barrier and to allow the cane bolt to be urged away from the lowered position when the cane bolt assumes a second angular orientation with respect to the movable barrier;

wherein the stop defines a central opening through which the cane bolt moves but through which the pin cannot move, the stop also defining at least one slot through which the pin can move when aligned with the slot in the second angular orientation;

a spring support engageable with the movable barrier below the stop and a spring trap coupled to the cane bolt above the spring support and below the stop and also being longitudinally distanced from the pin on the cane bolt, the spring being disposed in compression between the spring support and the spring trap when the cane bolt is engaged with the movable barrier, the stop and spring trap contacting each other with the pin above the stop and distanced therefrom when the cane bolt is in the raised position, the stop and spring trap being distanced from each other with the stop above the spring trap relative to a bottom end of the cane bolt and the pin contacting a bottom surface of the stop when the pin is not aligned with the slot and the cane bolt is in the lowered position, the stop being engageable with the movable barrier at an upper location above the spring trap relative to a bottom end of the cane bolt when the cane bolt is in the lowered position in which the spring is compressed between the spring trap and the spring support, the spring trap contacting the stop when the cane bolt is in the raised position in which the spring is expanded relative to the lowered position such that the spring expands and contracts between the stop and the spring trap, the stop being engaged at the upper location by welding or by a bracket.

* * * * *